US005774778A

United States Patent [19]

Adachi et al.

[11] Patent Number: 5,774,778

[45] Date of Patent: Jun. 30, 1998

[54] SHEET POST-PROCESSING APPARATUS AND IMAGE FORMING APPARATUS HAVING SAME

[75] Inventors: Seiichiro Adachi, Yokohama; Katsuhito Kato; Hitoshi Fujimoto, both of Kawasaki, all of Japan

[73] Assignee: Canon Kabushiki Kaisha, Japan

[21] Appl. No.: 899,315

[22] Filed: Jul. 30, 1997

Related U.S. Application Data

[63] Continuation of Ser. No. 363,325, Dec. 23, 1994, abandoned.

[30] Foreign Application Priority Data

Dec. 24, 1993 [JP] Japan ..... 5-348040

[51] Int. Cl.[6] ..... G03G 15/00

[52] U.S. Cl. ..... 399/403; 270/58.01; 270/58.08; 399/407

[58] Field of Search ..... 399/403–405, 399/407, 408; 270/58.01, 58.07, 58.08, 58.09, 58.11; 271/287, 293

[56] References Cited

U.S. PATENT DOCUMENTS

| | | | |
|---|---|---|---|
| 4,278,344 | 7/1981 | Sahay | 355/319 |
| 4,522,486 | 6/1985 | Clark et al. | 355/323 |
| 4,919,410 | 4/1990 | Robinson, Jr. et al. | 271/34 |
| 4,974,034 | 11/1990 | Rabb et al. | 355/319 |
| 5,078,376 | 1/1992 | Yamada et al. | 270/53 |
| 5,136,343 | 8/1992 | Braswell | 355/319 |
| 5,282,611 | 2/1994 | Ueda et al. . | |

*Primary Examiner*—William J. Royer
*Attorney, Agent, or Firm*—Fitzpatrick, Cella, Harper & Scinto

[57] ABSTRACT

A sheet post-processing apparatus for accommodating the sheet material discharged from an image forming apparatus on at least one sheet receiving tray and capable of accommodating at least two sets of sheet per sheet receiving tray, the apparatus includes controller for determines number of the sheet sets allowed to be accommodated per sheet receiving tray, on the basis of the number sheets of a set of originals, maximum number of the sheets accommodating per sheet receiving tray, and a correction coefficient.

27 Claims, 15 Drawing Sheets

SHEET POST-PROCESSING APPARATUS AND IMAGE FORMING APPARATUS HAVING SAME

This application is a continuation of application Ser. No. 08/363,325, filed Dec. 23, 1994, now abandoned.

FIELD OF THE INVENTION AND RELATED ART

The present invention relates to a post-sorting apparatus, and an image forming apparatus comprising the post-sorting apparatus. More specifically, it relates to a post-sorting apparatus which sequentially sorts and stores the sheets into a sheet receiving-storing tray (hereinafter, bin tray) as the sheets are discharged from an image forming apparatus such as a copying machine, laser beam printer, printing machine, or the like, bearing an image formed by the image forming apparatus, and to an image forming apparatus comprising such a post-sorting apparatus.

Generally speaking, this type of sheet post-sorting apparatus (sorter) sorts the sheets, which are discharged from the image forming apparatus, into the bin trays arranged either vertically or horizontally, in parallel, so that two or more sets of copies can be produced. Normally, it is rather difficult to sort the sheets to make a greater number of copy sets than the number of the bin trays available in the sorter. However, various measures have been taken to solve this problem.

One of the most effective measures is to shift the sheet sets on the bin tray. With the use of this method, it is possible to separate two or more sets of copies within a single bin tray, whether each set is stapled or processed likewise, or not.

In this case, whether two or more sets of copies can be sorted into a single bin or not is determined based on the relation between the number of the originals and the maximum number of sheets which can be accumulated in the single bin. For example, when a sorter is provided with bin trays which are capable of accommodating a maximum of 50 sheets per bin tray, and the number of sheets in a set of originals exceeds 26, it is not practical to sort two or more sets of copies into a single bin tray.

When the number of the sheets in the set of original is 17 to 15, it is allowed to sort two sets of copies into a single bin tray; when 13 to 16, up to three sets per bin; when two, up to 25 sets per bin; and so on.

However, in the case of the conventional method described above, the number of sets allowed to be sorted into a single bin tray is determined on the basis of the number of the sheets in the set of originals alone. Therefore, there are faults as described below.

Let it be assumed that multiple sets of copies are needed and the number of sheets to be discharged from an image forming apparatus is larger than the number of the sheets of the set of originals, for example, when both sides of a double sided original are copied using only one side of the recording sheets. Then, if the number of the sheets of the original alone is used to determine whether to permit the multiple sets accumulation or not, the number of the sheets discharged from the image forming apparatus during the multiple sets production may exceed the maximum storage capacity of the single bin tray. When this situation occurs, it may become impossible to align the sheets, or the sheets may drop out of the bin tray. Further, when the sheets sets are not bound, it may become impossible to tell one set of sheets from the other.

Next, let it be assumed that the number of the original sheets is more than 50, and the number of the sheets which are going to be discharged from the image forming apparatus is smaller than the number of the original sheets, for example, when a single sided original set is copied using both sides of the recording sheets, or when the so-called two-in-one mode is used, that is, when images from two original sheets are copied on a single recording sheet. In this case, even before the number of the sheets to be sorted into a single bin tray reaches half the maximum storage capacity of the bin tray, a control unit of the sorter may erroneously determine that the bin tray has been filled to the capacity, and stop the image forming apparatus, displaying a message of "Full bin" or the like.

SUMMARY OF THE INVENTION

The present invention was made in view of the fault of the conventional method described above, and its primary object is to provide a sheet post-processing apparatus capable of distributing properly the sheet sets among the bin trays while sorting the sheets; more specifically, a sheet post-processing apparatus capable of sorting accurately the sheets into the bin trays; aligning them precisely; binding them properly; or carrying out like operations appropriately.

According to the present invention, there is provided a sheet post-processing apparatus for accommodating the sheet material discharged from an image forming apparatus on at least one sheet receiving tray and capable of accommodating at least two sets of sheet per sheet receiving tray, the apparatus comprising: controlling means for determining the number of the sheet sets allowed to be accommodated per sheet receiving tray, on the basis of the number sheets of a set of originals, maximum number of the sheets accommodating per sheet receiving tray, and a correction coefficient.

According to an aspect of the present invention, the image formation mode is determined on the basis of whether the original is copied on one side or both sides.

According to another aspect of the present invention, the image formation mode is determined on the basis of whether the sheets discharged from the image forming apparatus are used on one side or both sides.

According to a further aspect of the present invention, the image formation mode is determined on the basis of whether or not an image from two or more sheets of original is copied on a single sheet.

According to a further aspect of the present invention, there is provided an image forming apparatus which accommodates the sheet material discharged from the image forming apparatus on at least one sheet receiving tray and is capable of accommodating at least two sets of sheet per sheet receiving tray, the apparatus comprising: controlling means for determining the number of the sheet sets allowed to be accommodated per sheet receiving tray, on the basis of the number of sheets of a set of originals, the maximum number of the sheets accommodated per sheet receiving tray, and a coefficient.

With the employment of such a method, the sheets are discharged from the image forming apparatus to the sheet post-processing apparatus, by the number equivalent to the number of sheet sets depositable on a single bin tray. Therefore, it is possible to always deposit an accurate number of the sheet sets on the sheet receiving tray; to align them; and to bind them or carry out like processes on them, and further, it is possible to carry out an image forming operation such as copying in the shortest operational time, without requiring additional operations.

The image formation mode is determined on the basis of: whether or not the original is copied on one side or both sides; whether or not the sheet discharged is used on one side or both sides; the type of copy mode such as two-in-one mode, in which a set of images from at least two original surfaces are formed on a single sheet; and the like factors, so that a proper number of sheet sets are deposited per sheet receiving tray.

With the employment of the above method, even when the image forming mode is different, it is possible to prevent such problems as overloading or underloading the sheet receiving tray with the sheet sets; therefore, a proper number of the sheet sets can be deposited.

As described above, according to the present invention, the number of sheet sets to be deposited per sheet receiving tray is recognized by controlling means on the basis of: the number of the sheets in a set of originals to be copied by the image forming apparatus; image formation mode; attributes of the sheet discharged from the image forming apparatus, and the thus determined number of the sheet sets are deposited per bin tray. Therefore, the sheets can be discharged from the image forming apparatus to the sheet post-sheet processing apparatus, by the number equivalent to the number of the sheet sets depositable per sheet receiving tray. As a result, the necessary number of the sheet sets can be stably deposited without inconveniences such as spilling the sheets from the bin trays or losing the dividing spots among the sheet sets.

Further, it is possible to produce the necessary number of the sheet sets, in the shortest processing time, without carrying out additional operations.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Embodiment 1

Figure 1:
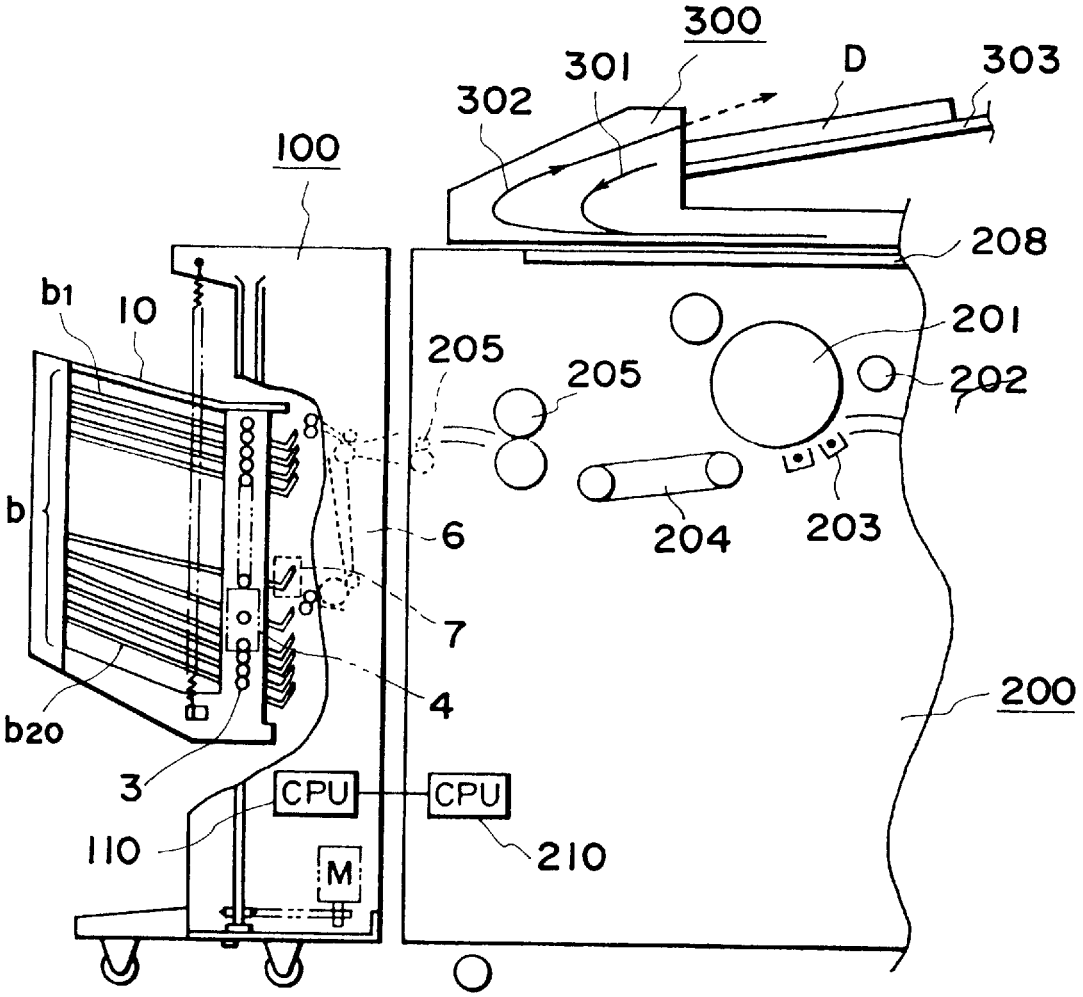
FIG. 1 is a schematic sectional view of a preferred embodiment of a sorting apparatus (sheet post-processing apparatus) according to the present invention, and an image forming apparatus to which this sorting apparatus is applicable.

FIG. 1 is a general view of a sheet post-processing apparatus according to the present invention, and an image forming apparatus. There are provided on the top surface of the main assembly of an image forming apparatus 200, an automatic original feeding apparatus 300 which automatically circulates the originals, and on the downstream side, a sorting apparatus (sheet post-processing apparatus) 100 comprising twenty bin trays b (b1, b2 . . . b19, and b20).

The image forming apparatus main assembly 200 employs a known electro-photographic system, which will be not be detailed here. Basically, it optically forms on a photosensitive drum 201 an image reflecting an original positioned on a platen glass 208; develops the image with a developing apparatus 202 disposed adjacent to the photosensitive drum 201; transfers the developed image onto a sheet S (FIG. 2) with a transfer electrode 203; and permanently fixes it with a fixing apparatus 205.

The sorting apparatus 100 is of a so-called moving bin type, in which vertically arranged bin trays are moved up or down through the rotation of a spiral cam 4, at a ratio of one bin interval per one rotation.

Figure 2:
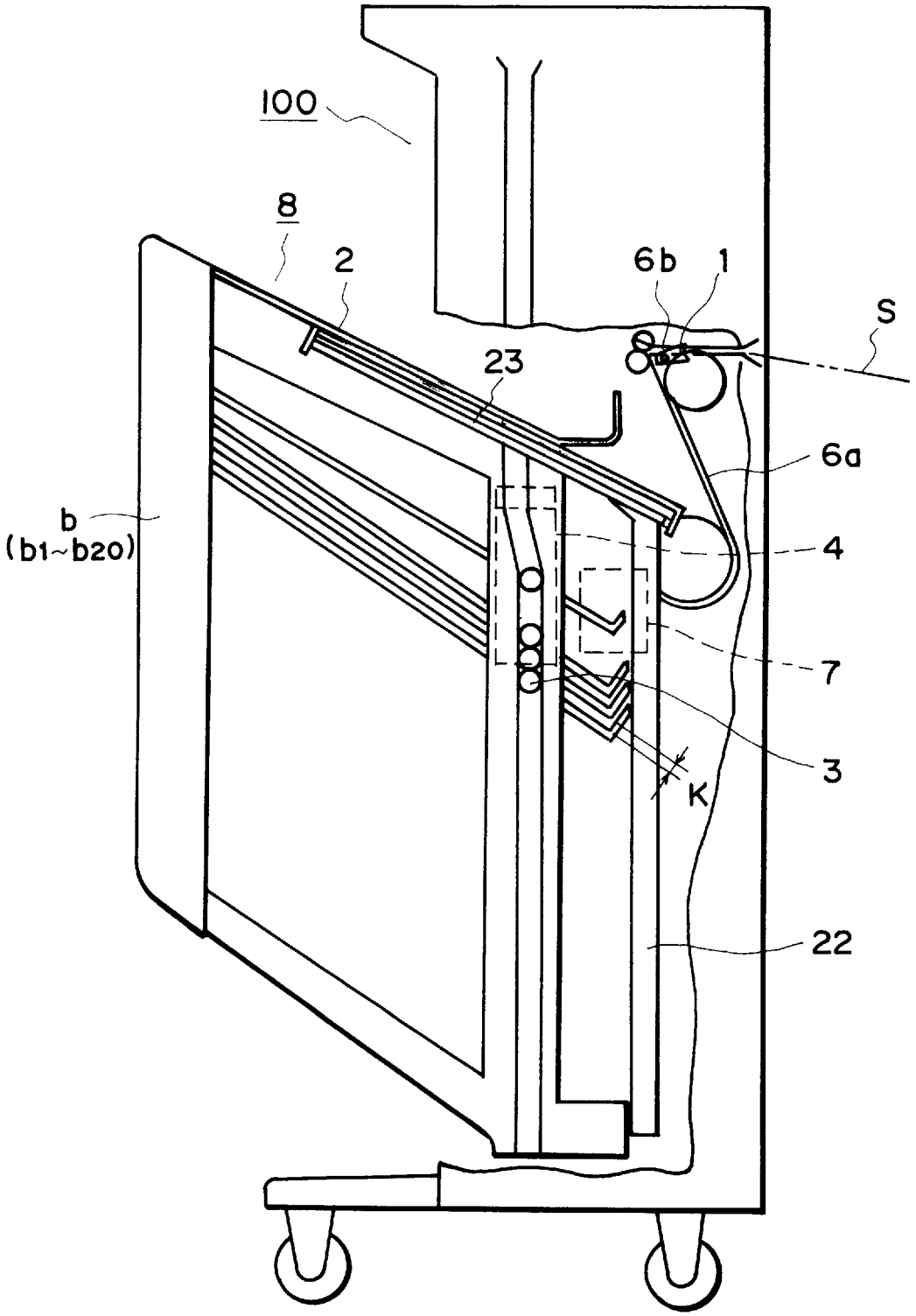
FIG. 2 is a longitudinal section of the same sorting apparatus.

The sheet S, on which an image has been formed by the image forming apparatus main assembly 200, is delivered to the sorting apparatus 100 by way of a discharge roller 205. In the sorting apparatus, the sheet S is directed either toward a sort path 6*a* or a non-sort path 6*b* by a flapper 1 (FIG. 2). In a non-sort mode during which the sheet S is not sorted, all the sheets S are passed through the non-sort path 6*b* and discharged into a non-sort tray 10 (flapper 1 is oriented as illustrated by a chain line). In a sort mode during which the sheet material S is sorted, it is passed through the sort path 6*a* (flapper 1 is oriented as illustrated by a solid line) and is discharged by the discharge roller so as to be stored one for one into each of the bin trays being synchronously moved up or down in the vertical direction.

Figure 3:
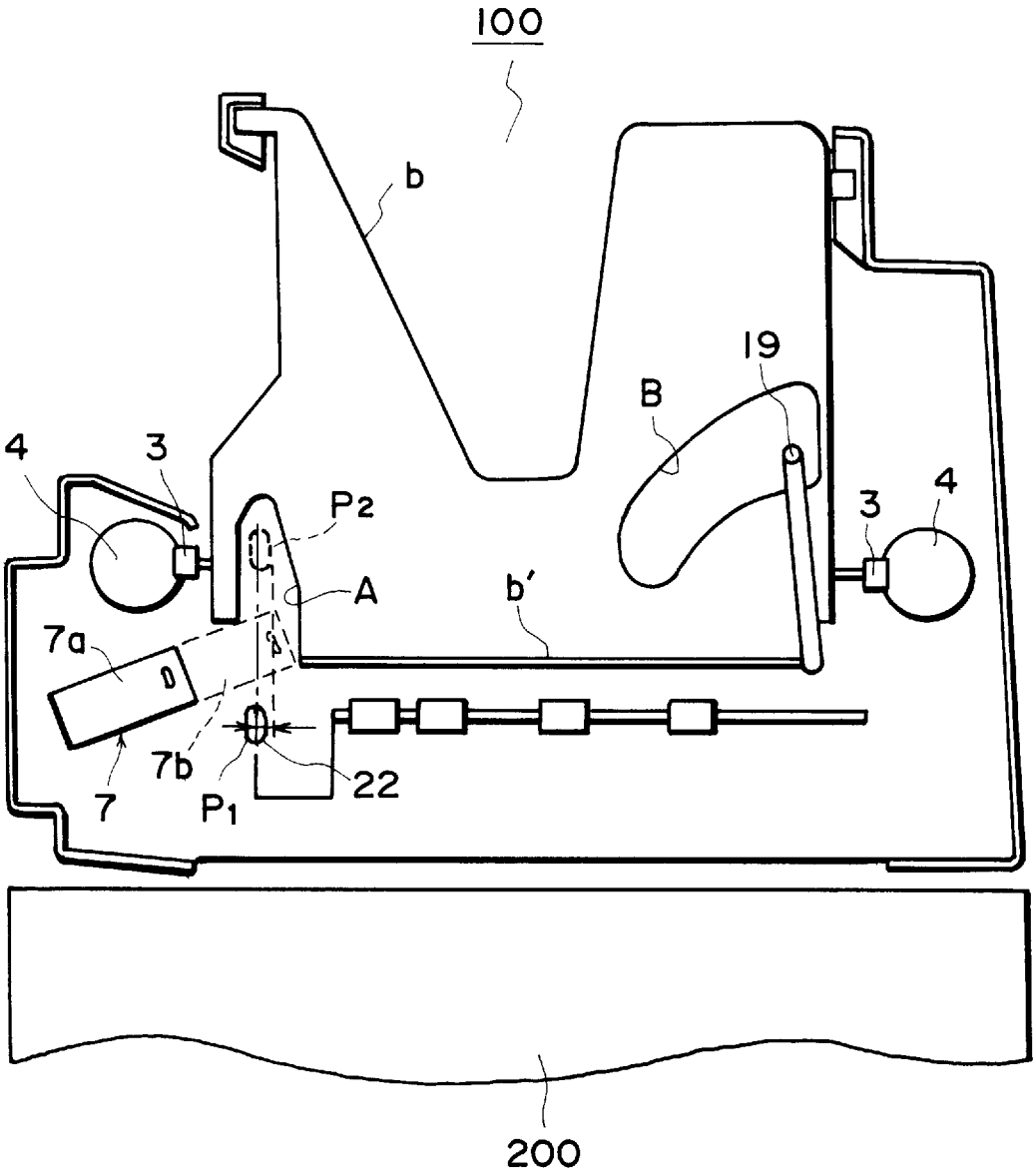
FIG. 3 is a plan view of the same sorting apparatus.

A portion designated by a reference numeral 7 is an electric stapler which staples the sheet material S. It is disposed at a predetermined location to face the bin tray b. Referring to FIG. 3, which is a top view of the sorting apparatus 100, the stapler 7 is moved by an unillustrated driving system between a position 7*a* (solid line), at which the stapler stands by, and a position 7*b* (chain line), at which it staples the sheets. The position 7*a* is off the bin tray b path, and the position 7*b* is within a notch A provided at one corner of the bin tray b.

Figure 4:
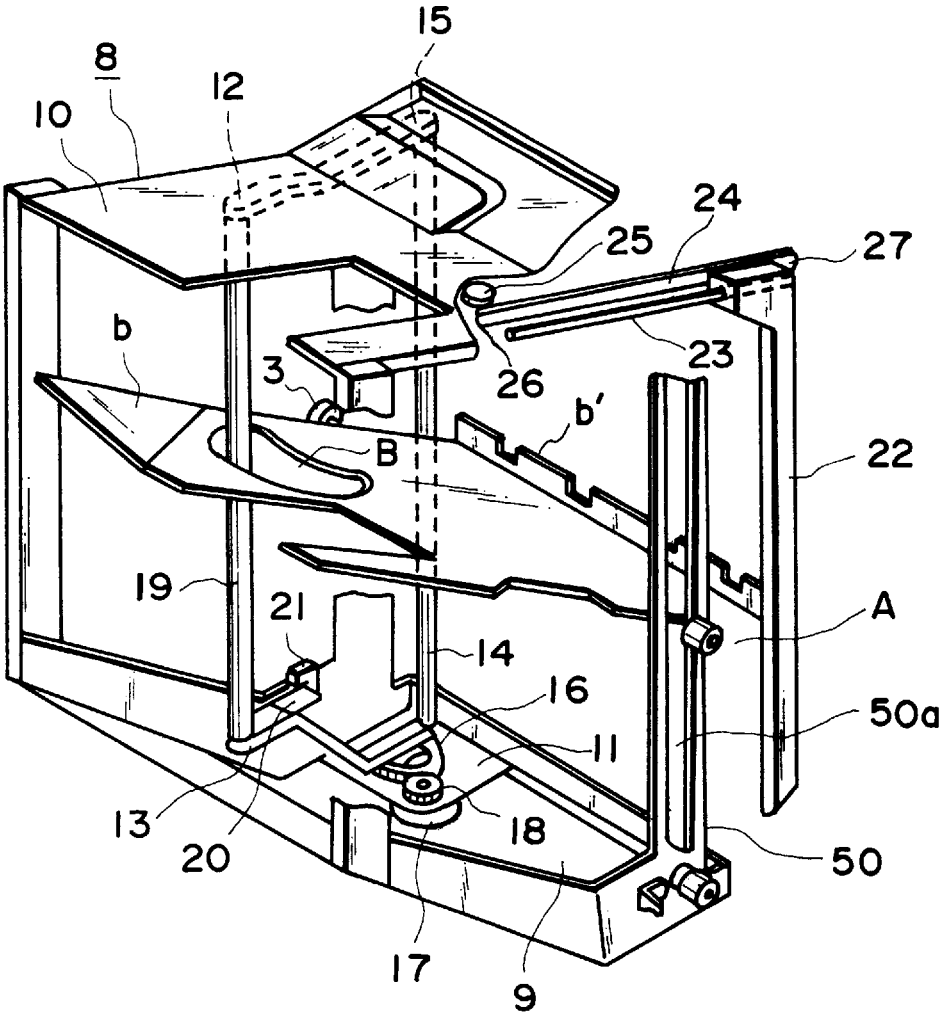
FIG. 4 is a perspective view of the bin unit of the same sorting apparatus.

Referring to FIG. 4, a bin unit 8 holding the bin tray b is composed of a non-sort tray 10, a base frame 9 and a pair of lateral guide plates 50, wherein the lateral guide plates 50 bridge between the non-sort tray 10 and the base frame 9, on the correspondent sides, giving the bin unit a box shape. The bin tray b is tilted in such a manner that its downstream side relative to the sheet discharging direction becomes lower. It has a pair of pins 3 (trunnions), each of which is fixed on the corresponding side of the bin tray b and is inserted in a hole 50*a* of the lateral guide plate 50.

There are attached on the bottom rear side of the base frame 9, a supporting plate 11, and on this supporting plate 11, an axial rod 14 is mounted, being fixed to an upper arm 12 by the top end, and to a bottom arm 13 by the bottom end. The axial rod 14 is rotatively supported between a rotational axis (unillustrated) provided on the supporting plate 11, and a rotational axis 15 provided on the bottom surface of the non-sort tray 10.

Further, there is disposed on the supporting plate 11, a sector gear 16, to which the bottom arm 13 is fixed. This sector gear 16 is rotatable about the axis provided on the supporting plate 11. Further, there is disposed on the bottom side of the supporting plate 11, a pulse motor 17, of which output shaft is fixed to a gear 18. The gear 18 meshes with the sector gear 16.

Between the tips of the top and bottom arms 13 and 12, an aligning rod 19 is bridged in a manner to penetrate through the opening B provided in each bin tray b. This aligning rod 19 is oscillated by the rotational oscillation of the sector gear 16. Further, a photo-interrupter plate 20 is provided on the bottom arm 13. It oscillates together with the bottom arm 13, turning on or off a home position sensor 21 provided also on the rear side of the base frame 9.

The bin tray b is provided with a notch A, which is located on the side opposite to where the aligning rod 19 is, and through this notch A, a reference rod 22 is put through. The reference rod 22 is mounted on a guide rail 23 supported right below the non-sort tray 10, and is fixed to a belt 24, which is stretched, in parallel to the guide rail 23, between a pulley 26 of a pulse motor 25 fixed below the non-sort tray 10, and an idler pulley 27. The reference rod 22 is movable between a position P1 (home position) and a position P2 by the forward or backward rotation of the pulse motor 25 as illustrated in FIG. 3, wherein the position P1 is a position off the bin tray b path (behind the stopper), where the reference rod 22 retreats, and the position P2 is where the reference rod 22 is when the sheets are aligned or pushed out.

The position P1 is detected using a sensor, and the position P2 is detected on the basis of a predetermined number of pulses applied to the pulse motor 25. The guide rail 23 is attached in such a manner that a slight offset K can be provided between the positions P1 and P2 in the horizontal plane (position P1 being closer to the front side), and at the same time, the moving direction of the reference rod 22 becomes substantially parallel to the tilt angle of the bin tray b to improve the efficiency with which the sheet on the bin tray b is pushed by the reference rod 22 (FIGS. 2 and 3).

Further, the image forming apparatus main assembly 200 and sorting apparatus illustrated in FIG. 1 comprise control circuits (CPU) 210 and 110, respectively, in order to control their operations and communications.

Next, referring to FIGS. 5–12, and 19, the operations of the sorting apparatus will be described.

(Step 1); an operator places an original D on an original table 303 of the automatic original feeding apparatus 300 illustrated in FIG. 1. Then, the operation of the image forming apparatus is started (start key is pressed) after optional information such as the number n of the copy sets to be made, stapling or not, copy mode (for example, a normal single side mode of making a single face copy from a single face original, a double side mode of making a single face copy from a double face original, a double side mode of making a double faced copy from a single face original, a two-in-one mode of copying two originals on a single recording medium, or the like) is entered through the control panel (unillustrated) of the image forming apparatus.

(Step 2); the control circuit 210 of the image forming apparatus main assembly 200 is informed of the sheet count N1 of the originals D. This number N1 may be directly entered by the operator, or the originals D is idled through the automatic original feeding apparatus 300 so that the sheets of the originals D are counted. At this point of the operation, the sheet set count N2 of the sheet sets having been deposited on a single bin tray is:

$$N=0$$

Further, a copy sheet count correction coefficient $\alpha$ is determined on the basis of the copy mode. The correction coefficient $\alpha$ is the product of an original correction coefficient a, a sheet correction coefficient b, and a single face original correction coefficient c.

The original correction coefficient a is:

| | |
|---|---|
| single face original | a = 1 |
| double face original | a = 2 |

The sheet correction coefficient b is:

| | |
|---|---|
| single face copy | b = 1 |
| double face copy | b = ½ |

The single face copy correction coefficient c is:

| | |
|---|---|
| normal function | c = 1 |
| two-in-one function | c = ½ |
| four-in-one function | c = ¼ |

For example:

| | |
|---|---|
| double face original-single face copy mode | $\alpha = 2 \times 1 \times 1 = 2$ |
| double face original-double face copy mode | $\alpha = 1 \times (½) \times 1 = ½$ |
| two-in-one mode | $\alpha = 1 \times 1 \times (½) = ½$ |

(Step 3); the coefficients obtained in Step 2, and the maximum number N3 of the sheets storable per bin tray obtained in advance by an experiment or the like are inputted in the control circuit 110 of the sheet post-processing apparatus, in which it is determined whether or not $\alpha$ satisfies the following formula:

$$N1 \times \alpha \leqq N3$$

In other words, it is confirmed that the sheet count in a single sheet set does not exceed the storage capacity per bin tray.

(Step 4); when "No" is the answer obtained in Step 3, it means that the number of sheets discharged to form a single sheet set exceeds the storage capacity per bin tray. Therefore, a warning message or the like is displayed on the unillustrated control panel to warn the operator of the situation and prompt the operator to change at least one setting among the original count and copy mode.

Figure 5:
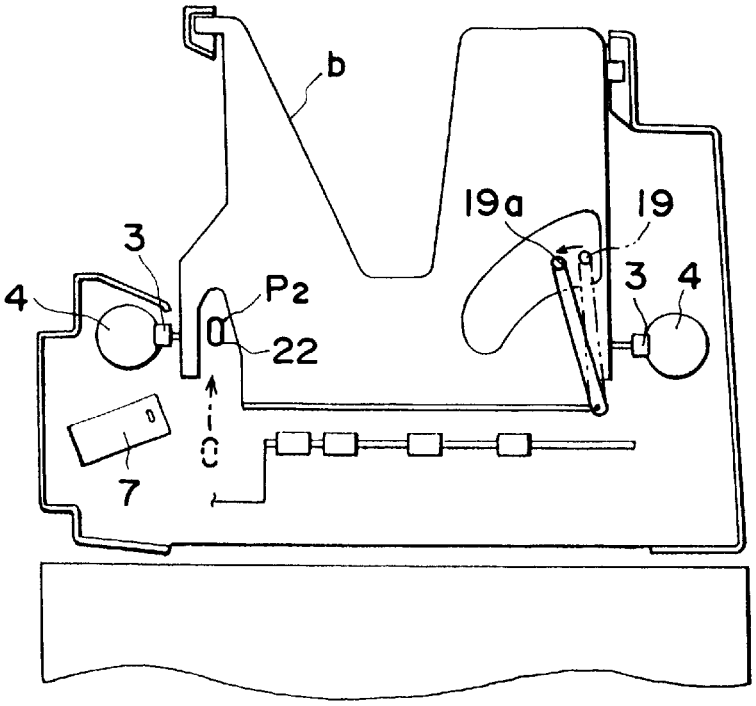
FIG. 5 is a plan view of the same sorting apparatus, and depicts the operation thereof.

(Step 5); when "Yes" is the answer obtained in Step 3, the reference rod 22 having been standing by at the home position is moved to the position P2 which serves as the reference position for the aligning operation, and the aligning rod 19 is moved from the home position to a standby position 19*a* corresponding to the size of the sheet to be discharged, as shown in FIG. 5.

(Steps 6 and 7); after the above preparation, the sheets discharged from the image forming apparatus main assembly 200 are sorted.

Figure 6:
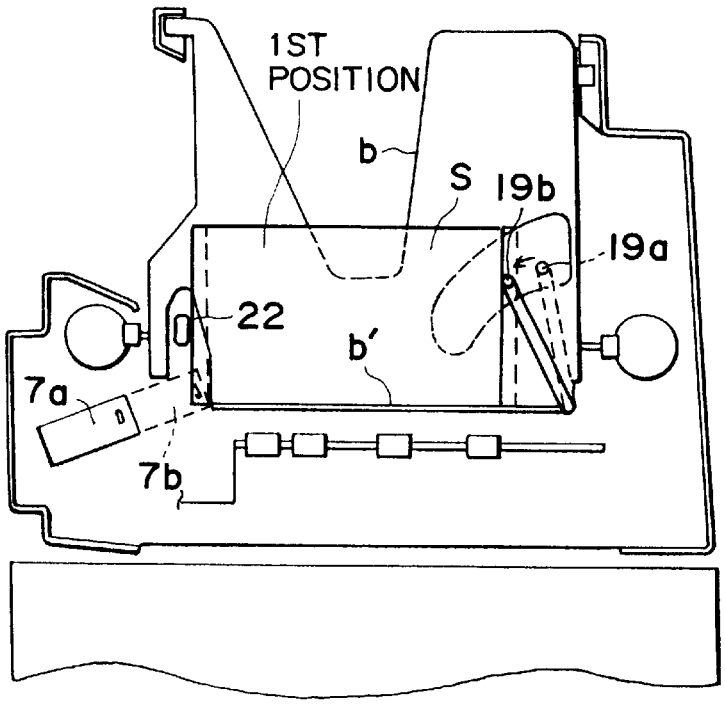
FIG. 6 is a plan view of the same sorting apparatus, and depicts the operation thereof.

At this time, when the number n is set to be higher than the bin tray count (20), the sorting operation is initially carried out for twenty sets. On the other hand, when the copy set count n is set to be smaller than the bin tray count, the sorting operation is carried out for n sets. The automatic original feeding apparatus separates a bundle of the originals D from the bottom; in other words, the original sheets are fed starting from the last original sheet. The separated sheet of the original is delivered onto a platen glass of the image forming apparatus main assembly 200 through a path 301 and stopped there (FIG. 1). Then, an unillustrated optical system functions to form an image. The sheet of recording medium on which the image has been transferred and fixed is passed through the sort path 6*a,* and is discharged into the first bin tray b1 (which has been standing by facing the discharge roller) (FIG. 6). The sheet discharged into the bin tray b1 slides down, by its own weight, on the surface of the bin tray tilted down toward the stopper b' (double dots chain line).

Then, the aligning rod 19 having been standing by at the standby position 19*a* is moved by the pulse motor 17 in the direction of an arrow, pushing the sheet as it comes in contact with the sheet edge. After being moved a predetermined distance, it is stopped at a first sheet position 19, and then, returned to the standby position 19*a* to be prepared for the next sheet discharge. When the aligning rod 19 is at the first sheet position 19*b*, one edge of the sheet is in contact with the aligning rod 19 and the other is in contact with the reference rod 22 (FIG. 6). The pulse motor 19 rotates in response to signals correspondent to the sheet size.

The above is the description of the sheet flow to the bin tray. Next, the spiral cam 4 is rotated to move the next bin tray to align it with the discharge roller, and the copy sheet on which the last page of the original has been copied is aligned, with its lateral edge being in contact with the reference rod 22 and the rear edge being in contact with the stopper b.'

After the image of the last page of the original is completely transferred, the original on the platen glass 208 is discharged, through a path 302, on top of the topmost sheet of the original sheet set D placed on the original table 303, wherein a separator lever (unillustrated) is interposed between the copied and yet-to-be copied originals to separate them.

The above operation is repeated the number of times corresponding to the number of sheets in the set of originals, whereby a predetermined number of copy sets are stored, being aligned, in the bin trays. At this time, the set of ordinals having been fed one cycle through the automatic original feeding apparatus is back in the normal order, that is, the first page is on top.

(Step 8); it is determined whether or not the mode set in Step 1 is "stapling mode." When it is "stapling mode," a Step 9 is taken, and when it is "non-stapling mode." the Step 1 is taken.

(Steps 9 and 10); as the stapler 7 having been standing by at the home position 7*a* receives a start signal from the control circuit 110, it moves to the stapling position 7*b* (broken line), as illustrated in FIG. 6, and places a staple at the rear corner of the sheet. At this time, the sheets are held from both sides by the reference rod 22 and aligning rod 19, respectively, being prevented from becoming misaligned. After stapling, the stapler 7 is returned to the home position 7*a*. Then, the spiral cam 4 is rotated once to move the bin trays by the single bin interval, so that the sheets on the next tray can be stapled.

The above operation is repeated to staple all the sheet sets.

Figure 7:
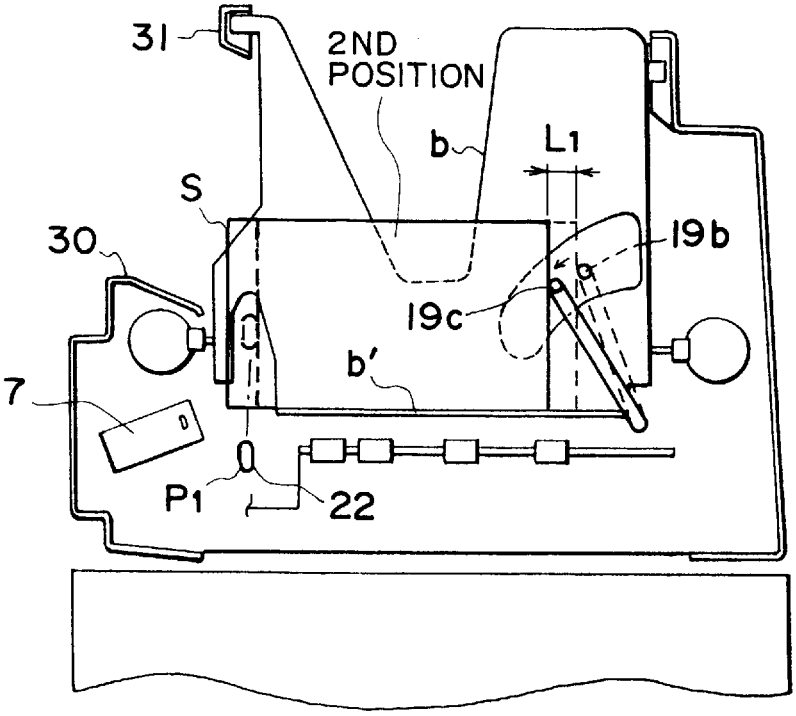
FIG. 7 is a plan view of the same sorting apparatus, and depicts the operation thereof.

(Step 11); the reference rod 22 having been in contact with the lateral edge of the sheet at the aligning reference position P2 is moved to the position P1 by the pulse motor 25 as shown in FIG. 7. The locus which the reference rod 22 follows at this time is such that the reference rod 22 moves away (by a distance k) from the sheet edge as described before; therefore, the sheet set is not disturbed by this movement of the reference rod 22.

(Step 12); next, as the pulse motor 17 is driven, the aligning rod 19 is moved a predetermined distance L1 (L1>k) from the aligning position 19*b* to a position 19*c*. As the aligning rod 19 moves, the sheet is pressed on the lateral edge, and therefore, is pushed out toward the front side of the apparatus (leftward of the drawing), sliding along the stopper b,' (second sheet position).

Figure 8:
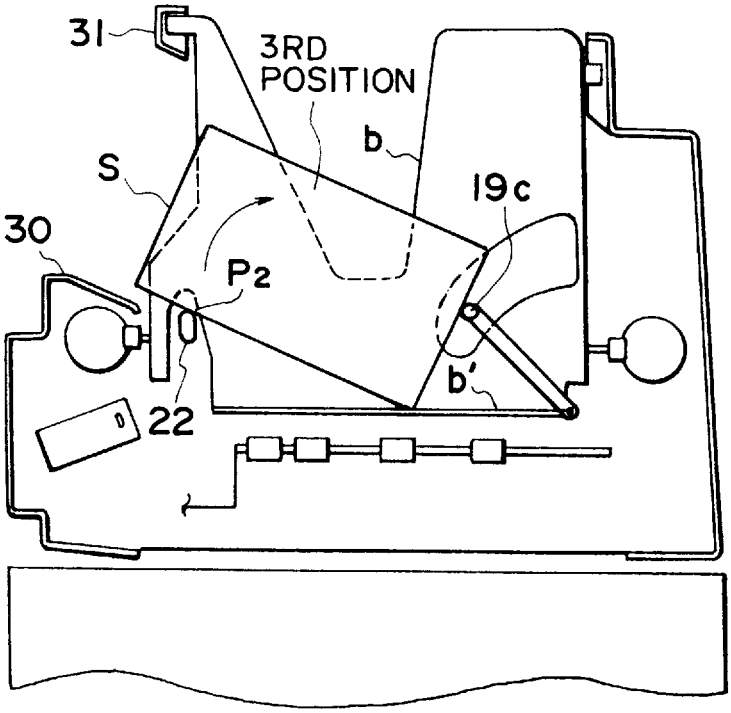
FIG. 8 is a plan view of the same sorting apparatus, and depicts the operation thereof.

(Step 13); the reference rod 22, which has retreated to the position P1 in Step 11, returns to the position P2 while pushing the rear edge of the sheet (FIG. 8). As a result, the sheet, which rests on the reference rod 22 by the rear edge and is held by the aligning rod 19 by the lateral edge, is skewed on the bin tray as illustrated in FIG. 8 (third sheet position).

Figure 9:
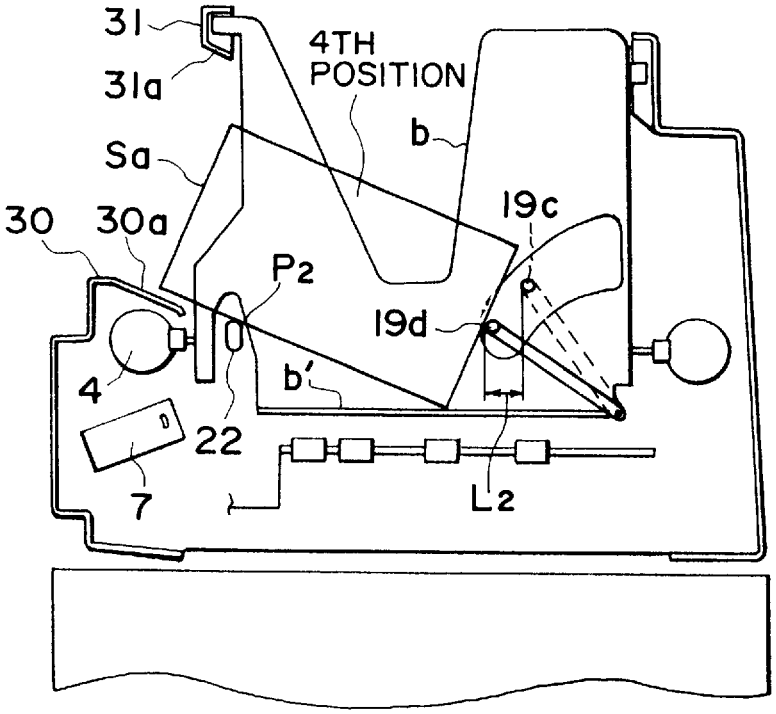
FIG. 9 is a plan view of the same sorting apparatus, and depicts the operation thereof.

(Step 14); then, the aligning rod 19 is moved in the direction of the arrow by a predetermined distance L2 (19*d*) as shown in FIG. 9. As a result, the lateral edge Sa of the sheet is clearly pushed out of the apparatus (fourth sheet position) by the above movement of the aligning rod 19, since a sufficient space for the sheet to pass is provided between the slanted surfaces 30*a* and 31*a* of front covers 30 and 31, respectively, of the sorting apparatus 100. Since the aligning rod 19 and reference rod 22 are put through all the bin trays, the sheets on all the bin trays are pushed toward the front of the apparatus, with no interference from the spiral cam 4, stapler 7, cover or the like, by the above movements.

(Step 15); at this point of time, one sheet set has been completed in one of the bins, or the sheet set count is increased by one; therefore:

$$N2=N2+1$$

(Step 16); it is determined whether or not the copy set count n, which had been set in Step 1, has been reached; in other words, it is checked whether or riot the following formula is satisfied:

$$n-(20\times N2)\leqq 0$$

(N2=1, at this point of time)

(Step 17); when the answer in Step 16 is "Yes," it means that the copy set count n has been met, and therefore, the apparatus operation ends.

(Step 18); when the answer in Step 16 is "No," a sequence for depositing two or more copy sets per bin tray is followed. At this time, it is determined whether or not an extra copy set can be deposited per bin tray; in other words, it is checked whether or not the following formula is satisfied:

$$N1\times(N2+1)\times\alpha\leqq N3$$

(storage capacity expressed in sheet count)

When the answer is "Yes," it means that one more copy sets can be deposited per bin tray, and therefore, the Step 5 is taken to do so.

(Step 19); when the answer in Step 18 is "No," the image forming apparatus 200 is temporarily stopped, and a message is displayed to prompt the operator to remove the sheet sets from the bin trays.

(Step 20); also when the above answer is "No," the operation of the image forming apparatus main assembly 200 is stopped after an unillustrated sensor for detecting the presence or absence of the sheet within the bin tray detects that the sheets have been removed from all the bin trays.

Below, a case in which two or more sheet sets are deposited per single bin tray will be described.

Figure 10:
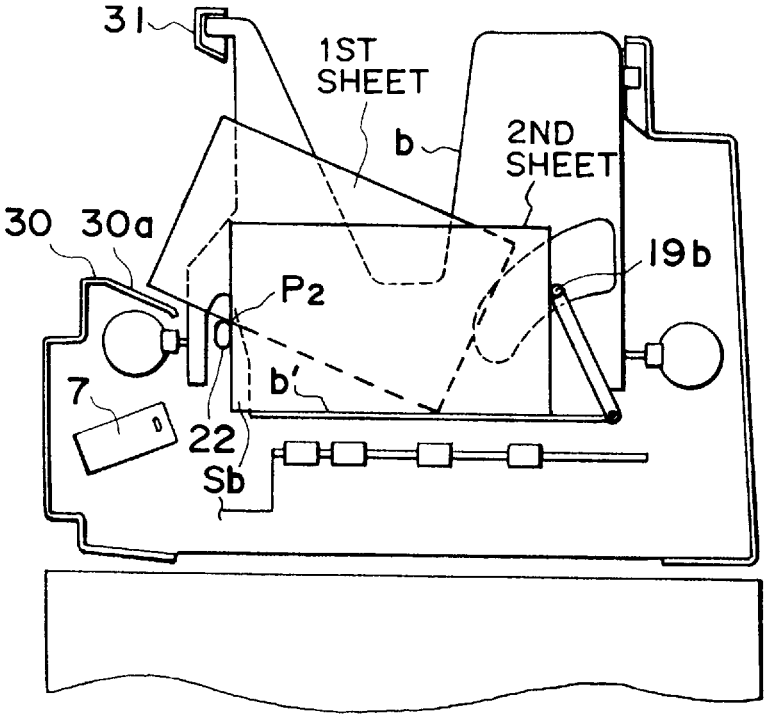
FIG. 10 is a plan view of the same sorting apparatus, and depicts its operation for responding to the second sheet set.

Referring to FIG. 10, a sheet S2, which belongs to the second set for the bin tray, is discharged on top of the first sheet set which has been obliquely situated at the fourth sheet position in the bin tray, and is aligned there in the same manner as the sheet in the first sheet sets. After the sorting operation, when it is determined that the "stapling mode" has been set, the second sheet set is stapled at a point within a non-overlapping area Sb between the first sheet set situated at the fourth sheet position and the second sheet set situated at the first sheet position, so that only the sheets S2 belonging to the second sheet sets situated at the first sheet position are stapled.

Figure 11:
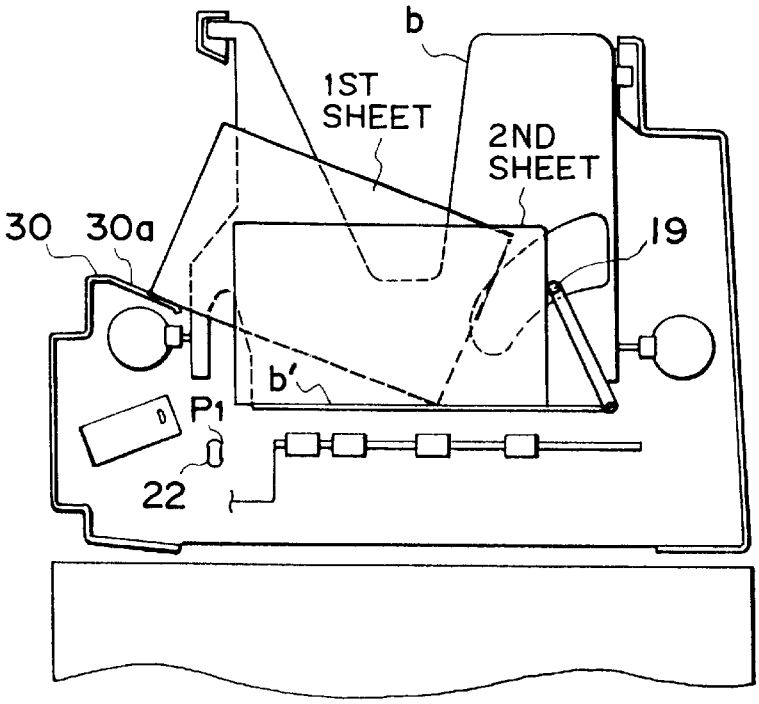
FIG. 11 is a plan view of the same sorting apparatus, and depicts its operation for responding to the second sheet sets.

Subsequently, the reference rod 22 is moved to the position P1 as it has been in Step 11. At this time, the rear corner of the first sheet set for the bin is rested on the end portion (slanted surface) 30*a* of the cover 30, and therefore, its attitude is not disturbed (FIG. 11). Next, the second sheet set is also pushed out to the fourth sheet position through the Steps 12–14. This sequence remains the same for the third sheet set and thereafter which are going to be deposited in the same bin, whereby two or more sheet sets are evenly stacked, each set being separable from adjacent ones by the presence of the staples.

Figure 12:
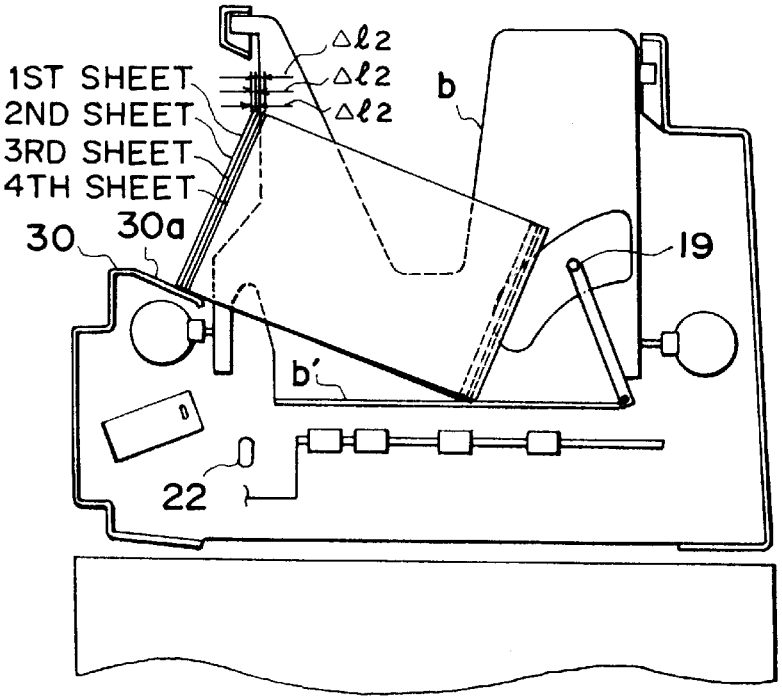
FIG. 12 is a plan view of the same sorting apparatus, and depicts how the sheet sets are separated during a stapling mode.
Figure 13:
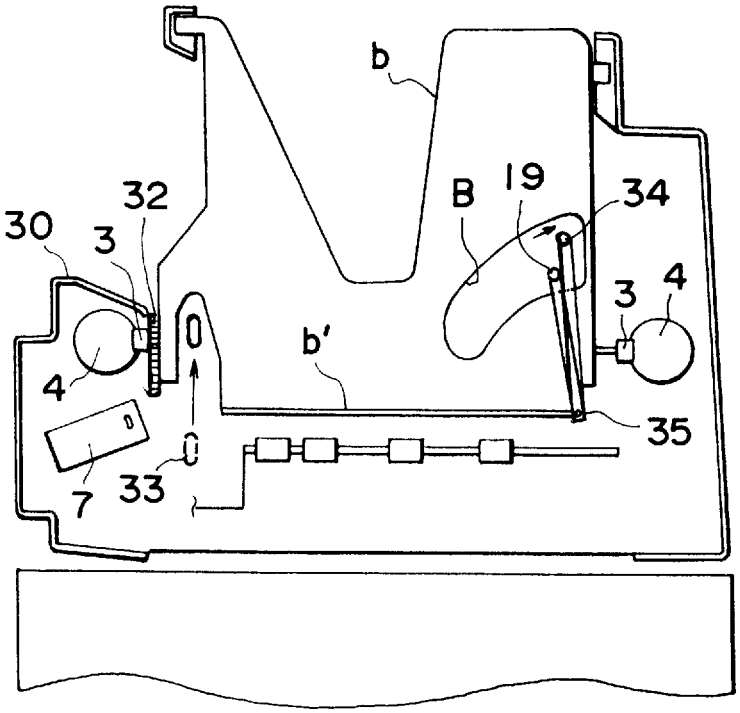
FIG. 13 is a plan view of another embodiment of the sorting apparatus according to the present invention.
Figure 14:
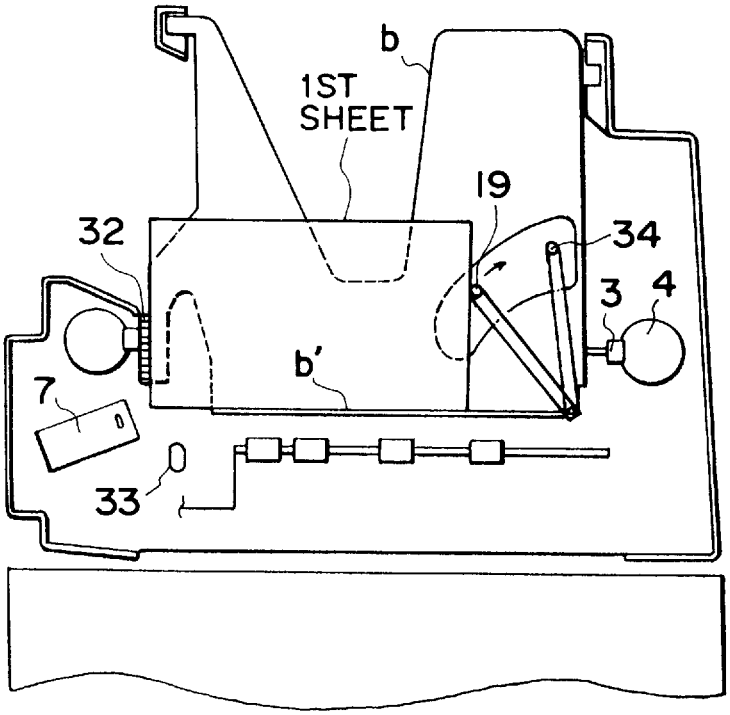
FIG. 14 is a plan view of the same sorting apparatus, and depicts the operation thereof.
Figure 15:
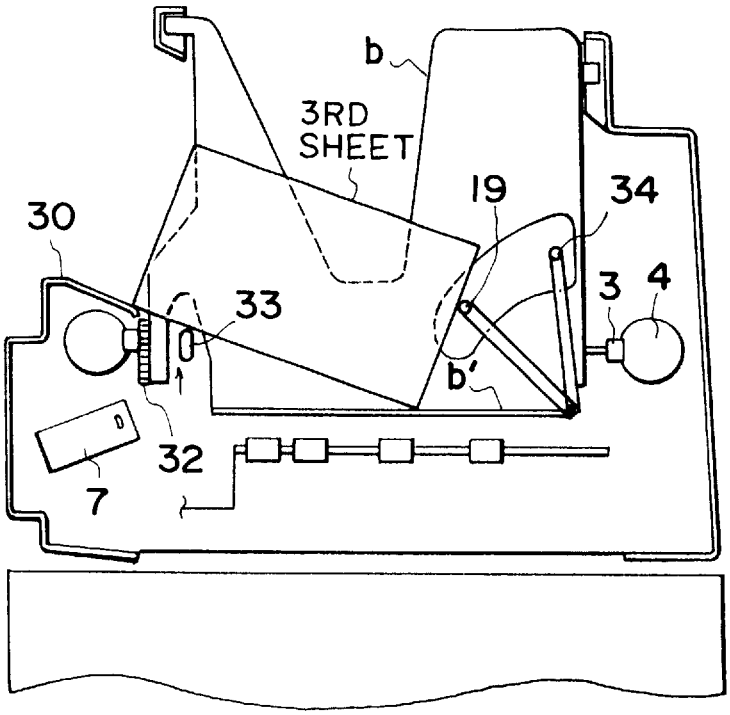
FIG. 15 is a plan view of the same sorting apparatus, and depicts the operation thereof.
Figure 16:
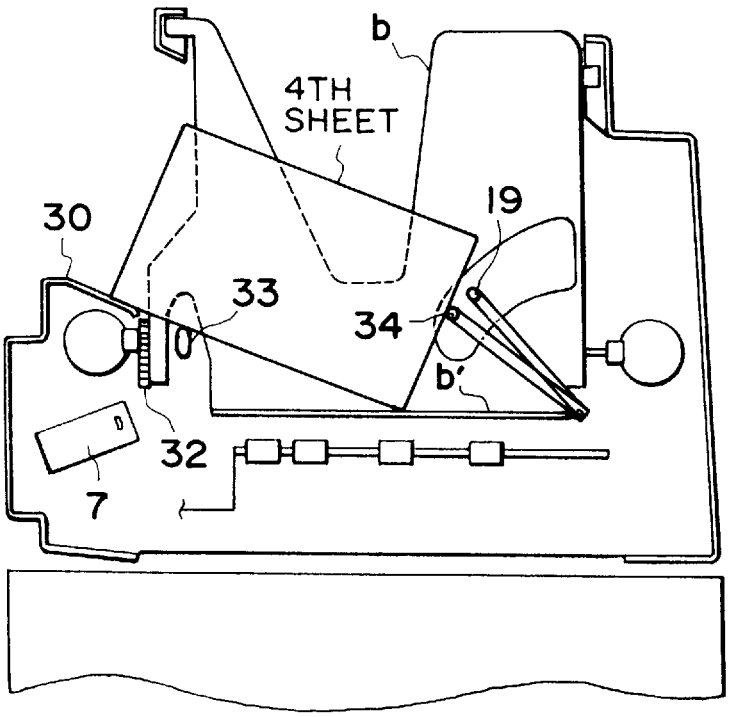
FIG. 16 is a plan view of the same sorting apparatus, and depicts the operation thereof.

On the other hand, when it is determined that the "non-stapling" mode has been set, the aligning rod 19 is also moved a predetermined distance, wherein in Step 14, the distance the aligning rod 19 is moved for the first sheet set is preset at L2, whereas in this case, the distance is set at (L2−Δ12) for the second sheet set, (L2−2×Δ12) for the third sheet set, and so on, whereby two or more sheet sets are stacked per bin tray in a staggered manner by an offset of Δ12 (FIG. 12).

The staggering method with the offset of Δ12 may be also employed to separate assertively the sheet sets when the "stapling" mode is set. The employment of this method will bring forth no adverse effect.

Further, when this sorting apparatus is used just to stagger the two or more sheet sets per bin tray, it is not always necessary for the sheet sets situated at the fourth sheet position to be partially projected from the apparatus. Instead, the sheet sets may be staggered using the skewed and straight positions.

With the use of the above control, it is possible Lo continue to deposit the sheet sets in each bin tray until the maximum sheet count per bin tray is reached.

Embodiment 2

In this embodiment, the number N2 of the sheet sets to be deposited per bin tray is calculated on the basis of the needed sheet set count n, and the obtained value of the sheet set number N2 per bin tray is entered as one of the control items before the sorting operation begins. In other words, N2 is set to satisfy the following formula:

$$N2=n/20$$

(figures below the fourth place of decimals are omitted) and then, the control is executed on the basis of this value of N2, the number N1 of the original, and the correction coefficient α which is determined on the basis of the copy mode in the same manner as in the first embodiment example.

Figure 20:
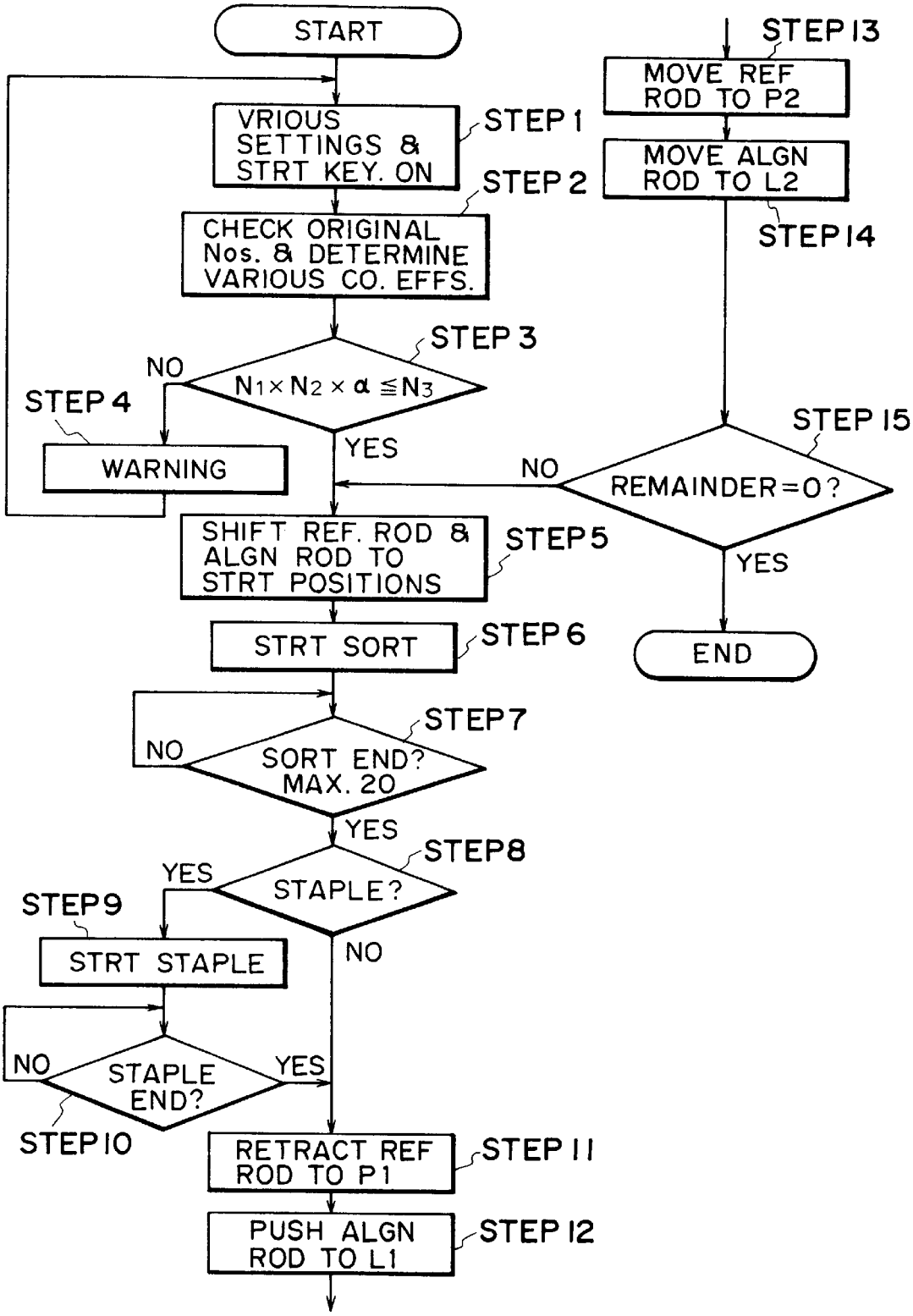
FIG. 20 is a flowchart for the second embodiment of the sorting apparatus according to the present invention.

The control diagram for this embodiment is shown in FIG. 20.

(Step 1); various settings are selected and the image forming apparatus main assembly 200 is started (start key is pressed).

(Step 2); coefficient N1 (sheet count of original), N2 (number of sheet sets to be deposited per bin tray), and α (copy count correction coefficient) are determined.

(Step 3); the number of the sheets which constitutes a single sheet set is estimated on the basis of various coefficients, and then, it is determined whether or not the thus estimated sheet count within the single set exceeds the maximum number of the sheets depositable per bin tray, using the following formula:

$$N1\times N2\times\alpha\leqq N3$$

(Step 4); when the answer in Step 3 is "No," it means that before a sheet set is completed, it becomes impossible to continue depositing the sheets on the bin tray, and therefore, a message is displayed to prompt the operator to change the setting for at least one of the original count N1, copy set count N2, and copy mode.

(Steps 5–14); when the answer is "Yes," the same operation as that of the first embodiment example 1 is carried out to produce the sheet sets.

(Step 15); in this embodiment example, after the operation of the image forming apparatus main assembly 200 is initiated, the sheet count does not exceed the maximum sheet count per tray, and therefore, even if the operator does not remove the sheets from the bin trays midway through the operation, the image forming apparatus keeps on operating till the selected number of sheet sets are produced.

Embodiment 3

In this embodiment, before starting the operation, the number of the sheet sets to be deposited per bin tray is controlled in consideration of the thickness of the sheet to be discharged into the bin tray.

When a mode, in which a cover sheet or a transparent sheet is inserted amount the plain sheets, is selected for the image forming apparatus main assembly 200, the number of the sheets depositable per bin tray is reduced since the paper used for the cover sheet or the transparent sheet is thicker than the plain ordinary sheet. Therefore, a coefficient to compensate for such a situation is taken into consideration.

Figure 21:
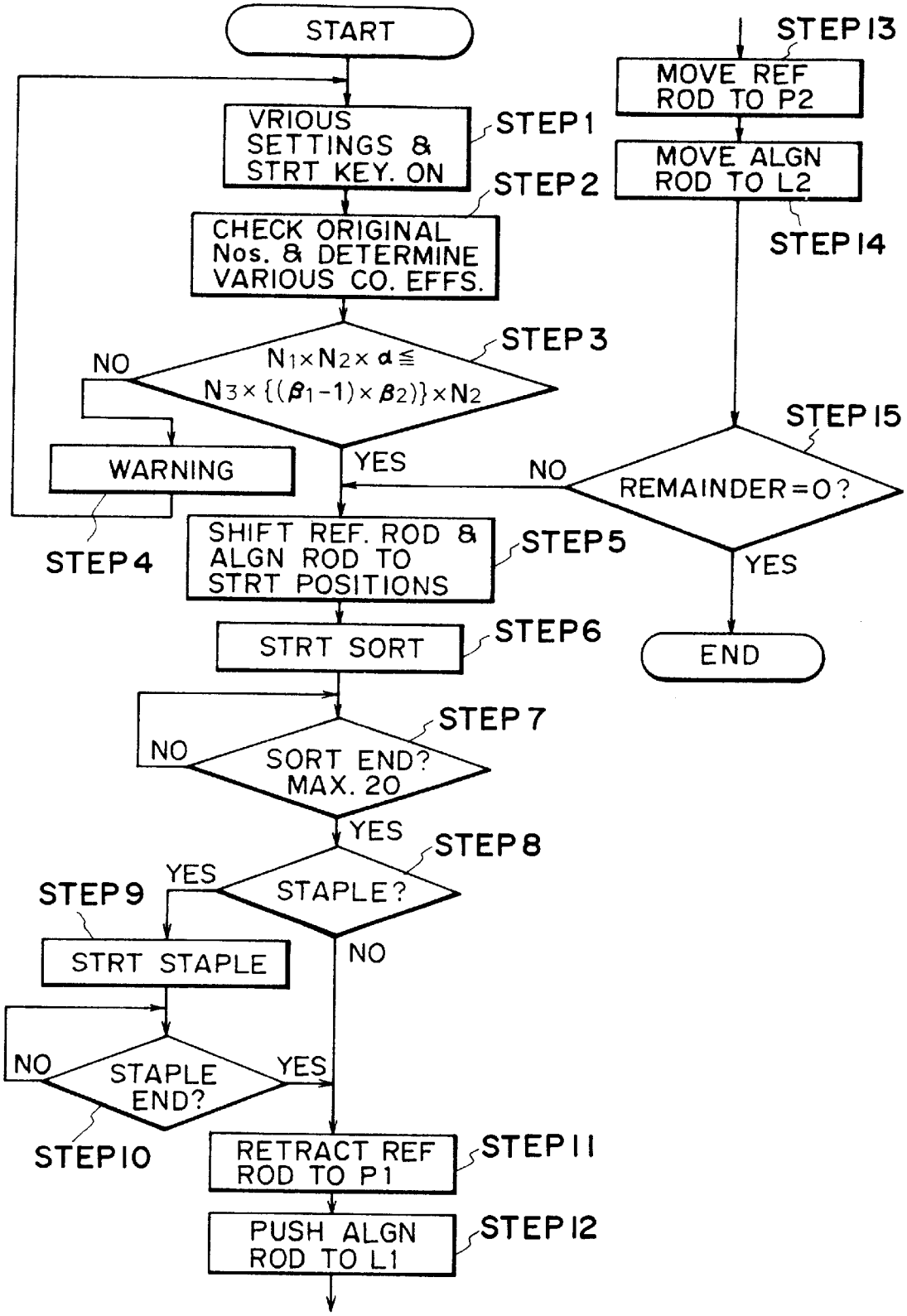
FIG. 21 is a flowchart for the third embodiment of the sorting apparatus according to the present invention.

The control diagram for such a situation is given in FIG. 21.

(Step 1); after various settings including the copy mode and cover sheet mode are selected, the operation of the image forming apparatus is initiated (start key is pressed).

(Step 2); coefficient N1 (sheet count for original), N2 (sheet set count to be deposited per bin tray), and a (copy count correction coefficient) are determined.

Further, a first and second correction coefficients β1 and β2 regarding the sheet thickness are determined and are preset, wherein the first coefficient β1 indicates how many times thicker the special sheet, such as the board paper used for the cover sheet or the transparent sheet, is that the plain ordinary sheet (sheet depositable by the sheet count of N3 per bin tray); for example, β1=3, for the board paper, and β1=2, for the transparent sheet. The second coefficient β2 determined in response to the selected mode indicates the number of special sheets in a single sheet set; for example, β2=2, when the cover sheet mode is selected.

(Step 3); the number of the sheets, which will have been deposited per bin when the necessary number of sheet sets will have been produced, is estimated on the basis of various coefficients, and then, it is determined whether or not the thus obtained number of the sheet sets exceeds the maximum sheet count per bin tray; in other words, it is determined whether or not the following formula is satisfied:

$$N1 \times N2 \times \alpha \leqq N3 - ((\beta 1 - 1) \times \beta 2) \times N2$$

wherein the maximum count N3 for the sheets depositable per bin tray is corrected using the first and second sheet thickness correction coefficient β1 and β2.

(Step 4); when the answer in Step 3 is "No," it means that before all the sheet sets are produced, it becomes impossible to deposit any more sheets on the bin trays, and therefore, d message is displayed to prompt the operator to change the setting for at least one of the original count N1, copy set count 2, and copy mode.

(Steps 5–15); when the answer is "Yes," the steps are the same as those described in the second embodiment example.

In this embodiment, the correction is made only for a special sheet such as a board sheet or transparent sheet, but the present invention is not limited to these kinds of recording material alone. For example, when the thickness of the plain ordinary sheet is different from the thickness of the referential sheet, which is depositable by the sheet count of N3, the same control may be executed in consideration of the correction coefficient for the difference in the thickness, so that the sorting operation can be more stably carried out.

Further, the depositable sheet count N3 in the first embodiment example may be corrected with the use of the sheet thickness correction coefficient β1 and β2 of this embodiment example.

Embodiment 4

In this embodiment, the number of the sheets allowed to be deposited per bin tray is controlled on the basis of the presence or absence of the binding such as staple.

Figure 22:
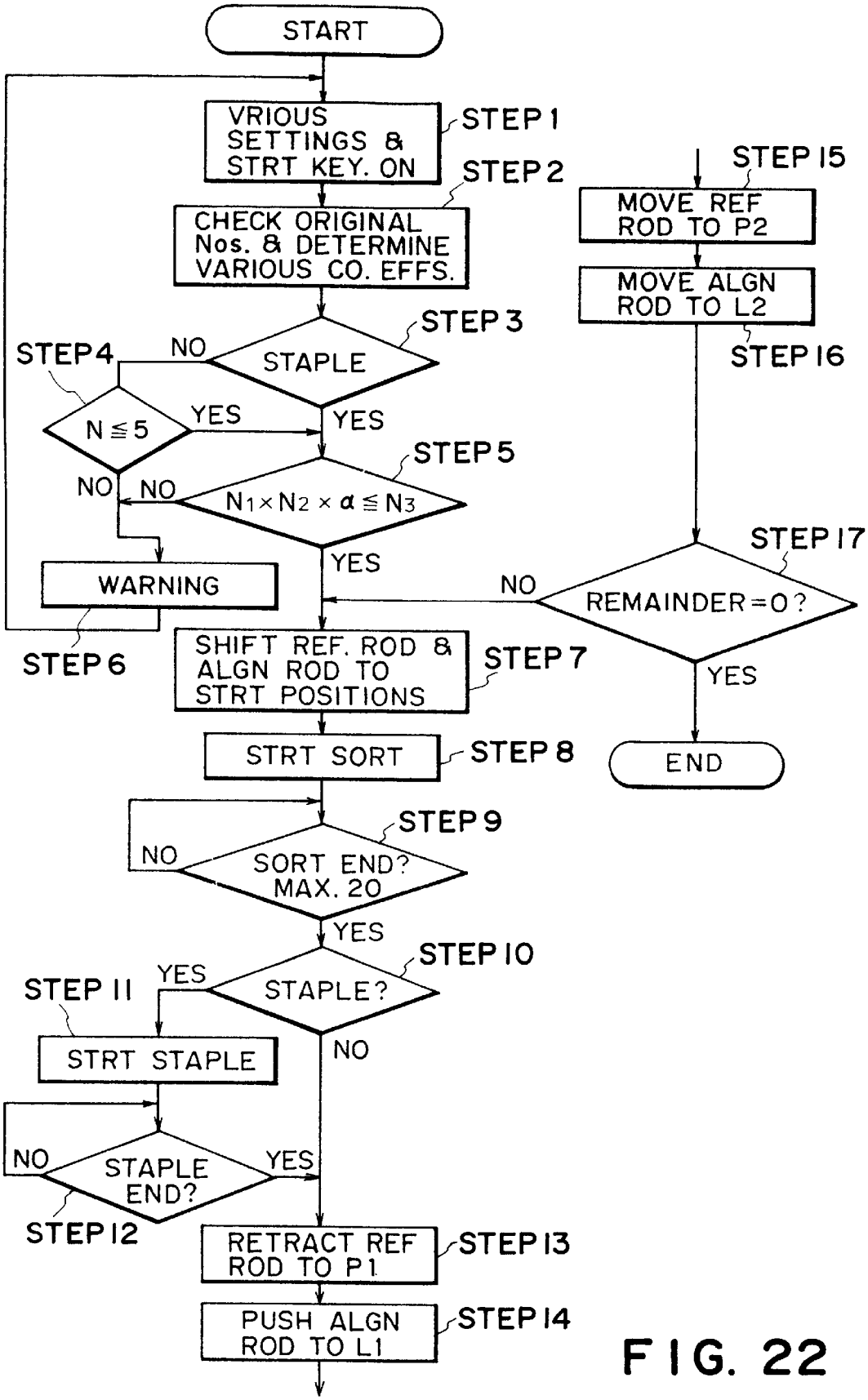
FIG. 22 is a flowchart for the fourth embodiment of the sorting apparatus according to the present invention.

When the sheet sets are bound by stapling or the like method, the sheet sets can be separated even if the sheet sets are evenly stacked on the bin tray. On the other hand, when the sheet sets are not bound by the staple or the like, they are stacked in a staggered manner with the predetermined offset as described before, so that the sheet sets can be separated. However, there is a limit in the staggering method. FIG. 22 shows a control diagram for an sorting operation, in which the sheet sets are not stapled, and the bin trays capable of accommodating up to five sheet sets are used.

(Step 1); the various settings including the copy mode, presence or absence of the staple are selected and the operation of the image forming apparatus is initiated (start key is depressed).

(Step 2); coefficient N1 (sheet count of original), N2 (sheet set count to be deposited per bin tray), and a (copy count correction coefficient) are determined.

(Step 3); it is determined whether or not the "stapling" mode has been set. In the case of "no stapling," Step 4 is taken, and in the case of "stapling," Step 5 is taken.

(Step 4); When in "no stapling" mode, the maximum number of the sheet sets allowed to be deposited per bin tray is five; therefore, the following formula is used to determine whether or not the sheet set count determined in Step 2 is no more than five:

$$N2 \leqq 5$$

When the answer in Step 4 is "Yes," Step 5 is taken, and when "No," Step 6 is followed.

(Step 5); the number of sheets, which will have been deposited per bin tray when the necessary number of sheet sets will have been produced with the presence of the staples, is estimated on the basis of various coefficients, and then, the following formula is used to determine whether or not the thus estimated sheet count exceeds the maximum count of the sheets depositable per bin tray:

$$N1 \times N2 \times \alpha \leqq N3$$

(Step 6); when the answer in Step 4 is "No," or the answer in Step 5 is "No," it means that before the necessary number of the sheet sets are produced, it becomes impossible to deposit any more sheets on the bin tray, and therefore, a message is displayed to prompt the operator to change the setting for at least one of the original count N1, copy set count n, copy mode, and stapling or non-stapling.

(Steps 7–17); when the answer is "Yes," the same operations as those in Steps 5–15 are carried out to produce the sheet sets.

Further, the depositable sheet set count N2, which is determined on the basis of the presence or absence of the staple as it is in this embodiment, may be incorporated into the first or third embodiment example.

The effects of the present invention are not limited by the type of sorter; in other words, the present invention is applicable to different types of sorters as long as they are of the type in which the sheet sets on the bin tray are shifted.

Figure 17:
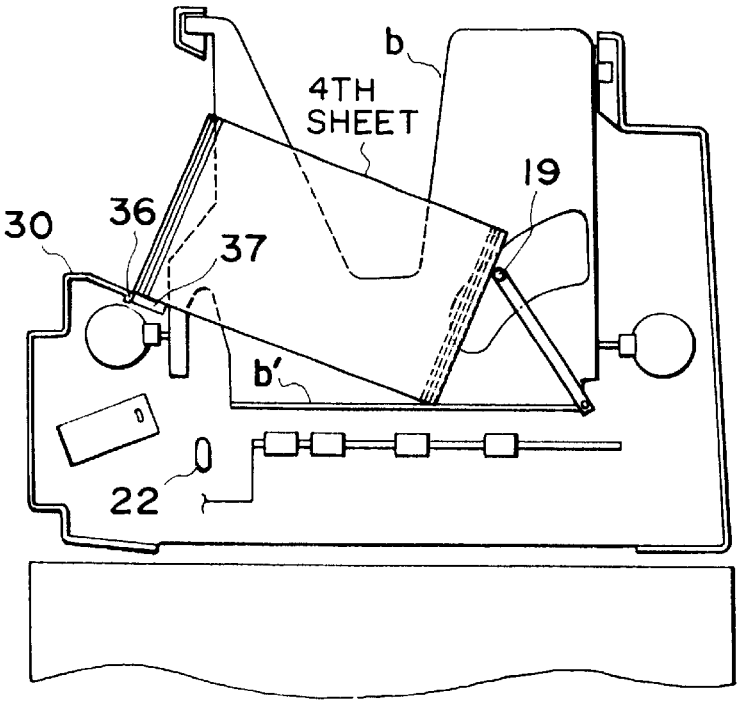
FIG. 17 is a plan view of another embodiment of the sorting apparatus according to the present invention.
Figure 18:
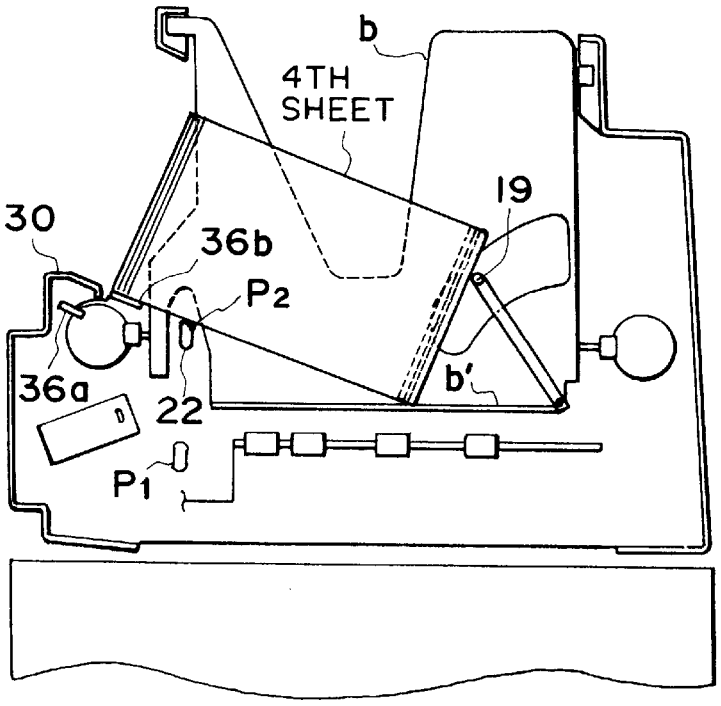
FIG. 18 is a plan view of another embodiment of the sorting apparatus according to the present invention.
Figure 19:
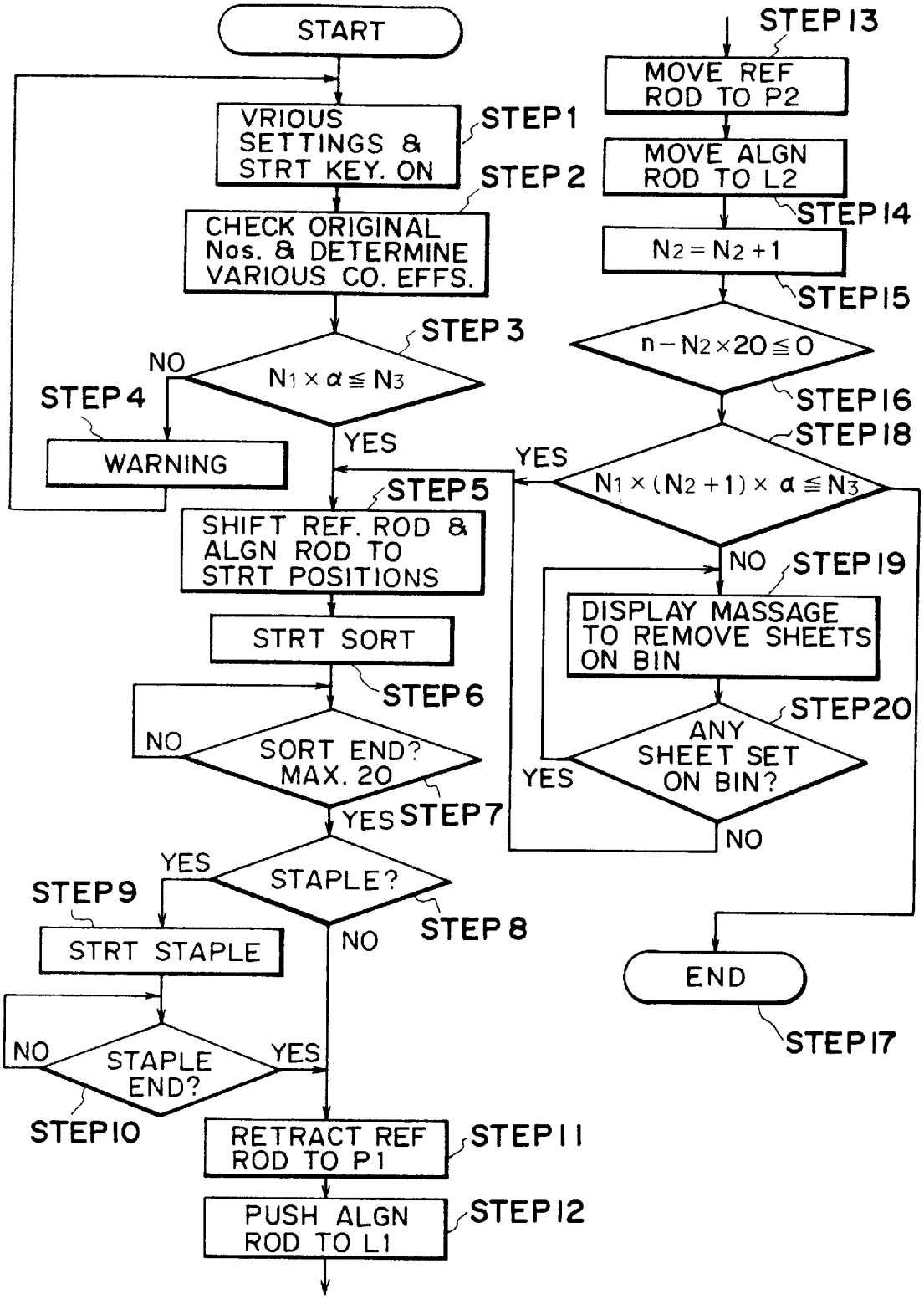
FIG. 19 is a flowchart for the first embodiment of the sorting apparatus according to the present invention.

FIGS. 13–16 are plan views of the sorting apparatus of different types; FIG. 17 is a plan view of another sorting apparatus of a different type; and FIG. 18 is also a plan view of another sorting apparatus of a different type.

While the invention has been described with reference to the structures disclosed herein, it is not confined to the details set forth and this application is intended to cover such modifications or changes as may come within the purposes of the improvements or the scope of the following claims.

What is claimed is:

1. A sheet post-processing apparatus for accommodating the sheet material discharged from an image forming apparatus on a plurality of sheet receiving trays and capable of accommodating at least two sets of sheets per sheet receiving tray, said apparatus comprising:

controlling means for determining the number of the sheet sets allowed to be accommodated per sheet receiving tray, on the basis of the number of sheets of a set of originals, the maximum number of the sheets allowed to be accommodated per sheet receiving tray and a correction coefficient, wherein the sheet receiving trays are arranged at predetermined intervals.

2. A sheet post-processing apparatus according to claim 1, wherein said correction coefficient is determined on the basis of whether the original is copied on one side or both sides.

3. A sheet post-processing apparatus according to claim 1, wherein said correction coefficient is determined on the basis of whether the sheet discharged from the image forming apparatus is used on one side or both sides.

4. A sheet post-processing apparatus according to claim 1, wherein said correction coefficient is determined on the basis of whether images from at least two originals are copied on a single sheet.

5. A sheet post-processing apparatus according to claim 1, wherein the number of sheet sets to be accommodated per sheet receiving tray is determined before a sheet discharging operation begins.

6. A sheet post-processing apparatus according to claim 5, wherein when said apparatus is set to accommodate more sheets per sheet receiving tray than the maximum number of the sheet sets accommodatable per sheet receiving tray, the operation of said apparatus being prevented until the setting is changed.

7. A sheet post-processing apparatus according to claim 5, wherein the plurality of the sheet sets accommodated on the sheet receiving tray are stacked in a deviated manner.

8. A sheet post-processing apparatus according to claim 1, wherein whether a plurality of sheet sets to be accommodated on a single sheet receiving tray is determined each time a set of sheet is accommodated.

9. A sheet post-processing apparatus according to claim 8, wherein when said apparatus is set to accommodate more sheets per sheet receiving tray than the maximum number of the sheets accommodatable per sheet receiving tray, the maximum number of the sheet sets accommodatable per sheet receiving tray is produced, and then, the rest of the sheet sets to be produced are produced after the sheets sets produced through the preceding run are removed from the sheet receiving tray.

10. A sheet post-processing apparatus for accommodating the sheet material discharged from an image forming apparatus on at least one sheet receiving tray and capable of accommodating at least two sets of sheets per sheet receiving tray, said apparatus comprising:

controlling means for determining the number of the sheet sets allowed to be accommodated per sheet receiving tray, on the basis of the number of sheets of a set of originals, the maximum number of the sheets allowed to be accommodated per sheet receiving tray and a correction coefficient, wherein said correction coefficient is determined on the basis of whether a special sheet is among the sheets discharged from the image forming apparatus.

11. A sheet post-processing apparatus for accommodating the sheet material discharged from an image forming apparatus on at least one sheet receiving tray and capable of accommodating at least two sets of sheets per sheet receiving tray, said apparatus comprising:

controlling means for determining the number of the sheet sets allowed to be accommodated per sheet receiving tray, on the basis of the number of sheets of a set of originals, the maximum number of the sheets allowed to be accommodated per sheet receiving tray and a correction coefficient, wherein said correction coefficient is determined on the basis of the thickness of the sheet discharged from the image forming apparatus.

12. A sheet post-processing apparatus for accommodating the sheet material discharged from an image forming apparatus on at least one sheet receiving tray and capable of accommodating at least two sets of sheets per sheet receiving tray, said apparatus comprising:

controlling means for determining the number of the sheet sets allowed to be accommodated per sheet receiving tray, on the basis of the number of sheets of a set of originals, the maximum number of the sheets allowed to be accommodated per sheet receiving tray and a correction coefficient, wherein said correction coefficient is determined on the basis of the presence or absence of a binding instruction.

13. An image forming apparatus which accommodates the sheet material discharged from an image forming means on at least one sheet receiving tray and is capable of accommodating at least two sets of sheet per sheet receiving tray, said apparatus comprising:

controlling means for determining the number of the sheet sets allowed to be accommodated per sheet receiving tray, on the basis of the number of sheets of a set of originals, the maximum number of the sheets allowed to be accommodated per sheet receiving tray, and a correction coefficient, wherein said correction coefficient is determined on the basis of whether a special sheet is among the sheets discharged from the image forming apparatus.

14. An image forming apparatus according to claim 13, wherein said image forming apparatus comprises an automatic original feeding apparatus, and a sheet post-processing apparatus.

15. An image forming apparatus according to claim 14, wherein said sheet post-processing apparatus is a sorting apparatus comprising a plurality of sheet receiving trays.

16. An image forming apparatus according to claim 14, wherein the number of sheets of a set of originals is manually inputted.

17. An image forming apparatus according to claim 14, wherein the number of sheets of a set of originals is counted by circulating the originals by said automatic original feeding apparatus.

18. An image forming apparatus according to claim 13, wherein the number of sheet sets to be accommodated per sheet receiving tray is determined before a sheet discharging operation begins.

19. An image forming apparatus according to claim 18, wherein when said apparatus is set to accommodated more sheets per sheet receiving tray than the maximum number of the sheets accommodated per sheet receiving tray, the maximum number of the sheet sets depositable per sheet receiving tray are produced, and then, the rest of the sheet sets to be produced are produced after the sheets sets produced through the preceding run are removed from the sheet receiving tray.

20. An image forming apparatus according to claim 13, wherein whether or not to accommodate a plurality of sheet sets on a single sheet receiving tray is determined each time a sheet set is accommodated.

21. An image forming apparatus according to claim 13, wherein when said apparatus is set to accommodate more sheets per sheet receiving tray than the maximum number of the sheet sets depositable per sheet receiving tray, the operation of said image forming apparatus being prevented until the setting is changed.

22. An image forming apparatus which accommodates the sheet material discharged from an image forming means on at least one sheet receiving tray and is capable of accommodating at least two sets of sheet per sheet receiving tray, said apparatus comprising:

controlling means for determining the number of the sheet sets allowed to be accommodated per sheet receiving tray, on the basis of the number of sheets of a set of originals, the maximum number of the sheets allowed to be accommodated per sheet receiving tray, and a correction coefficient, wherein said correction coefficient is determined on the basis of the thickness of the sheet discharged from the image forming apparatus.

23. An image forming apparatus which accommodates the sheet material discharged from an image forming means on at least one sheet receiving tray and is capable of accommodating at least two sets of sheet per sheet receiving tray, said apparatus comprising:

controlling means for determining the number of the sheet sets allowed to be accommodated per sheet receiving tray, on the basis of the number of sheets of a set of originals, the maximum number of the sheets allowed to be accommodated per sheet receiving tray, and a correction coefficient, wherein said correction coefficient is determined on the basis of the presence or absence of a binding instruction.

24. An image forming apparatus which accommodates the sheet material discharged from an image forming means on a plurality of sheet receiving trays and is capable of accommodating at least two sets of sheet per sheet receiving tray, said apparatus comprising:

controlling means for determining the number of the sheet sets allowed to be accommodated per sheet receiving tray, on the basis of the number of sheets of a set of originals, the maximum number of the sheets allowed to be accommodated per sheet receiving tray, and a correction coefficient, wherein the sheet receiving trays are arranged at predetermined intervals.

25. An image forming apparatus according to claim 24, wherein said correction coefficient is determined on the basis of whether the original is copied on one side or both sides.

26. An image forming apparatus according to claim 24, wherein said correction coefficient is determined on the basis of whether the sheet discharged from the image forming apparatus is used on one side or both sides.

27. An image forming apparatus according to claim 24, wherein said correction coefficient is determined on the basis of whether images from at least two originals are copied on a single sheet.

* * * * *

UNITED STATES PATENT AND TRADEMARK OFFICE

CERTIFICATE OF CORRECTION

PATENT NO. : 5,774,778

DATED : June 30, 1998

INVENTOR(S) : SEIICHIRO ADACHI, ET AL.

On the title page,

Item [73] Assignee:

"Japan" should read --Tokyo, Japan--.

Item [57] Abstract:

Line 5, "determines" should read --determining the--.

IN THE DRAWINGS:

Sheet 12, "vrious" should read various--.
Sheet 13, "vrious" should read various--.
Sheet 14, "vrious" should read various--.
Sheet 15, "vrious" should read various--.

COLUMN 4:

Line 38, "be" (first occurrence) should be deleted.

COLUMN 7:

Line 46, "correspondent" should read --corresponding--.

COLUMN 8:

Line 3, "mode." should read --mode,--; and
Line 59, "riot" should read --not--.

UNITED STATES PATENT AND TRADEMARK OFFICE

CERTIFICATE OF CORRECTION

PATENT NO. : 5,774,778

DATED : June 30, 1998

INVENTOR(S) : SEIICHIRO ADACHI, ET AL.

COLUMN 9:

Line 65, "Lo" should read --to--.

COLUMN 11:

Line 2, "a" should read --α--; and
Line 30, "d" should read --a--.

COLUMN 12:

Line 2, "a" should read --α--; and
Line 19, "will" should be deleted.

COLUMN 14:

Line 15, "sets of sheet" should read --sets of sheets--;
Line 45, "accommodeted" should read --accommodate--; and
Line 66, "sets of sheet" should read --sets of sheets--.

COLUMN 15:

Line 13, "sets of sheet" should read --sets of sheets--.

UNITED STATES PATENT AND TRADEMARK OFFICE

CERTIFICATE OF CORRECTION

PATENT NO. : 5,774,778

DATED : June 30, 1998

INVENTOR(S) : SEIICHIRO ADACHI, ET AL.

COLUMN 16:

Line 2, "sets of sheet" should read --sets of sheets--.

Signed and Sealed this

Thirtieth Day of March, 1999

Q. Todd Dickinson

Q. TODD DICKINSON

*Acting Commissioner of Patents and Trademarks*

*Attest:*

*Attesting Officer*